US010974890B1

(12) United States Patent
Wagner

(10) Patent No.: US 10,974,890 B1
(45) Date of Patent: Apr. 13, 2021

(54) CONTAINER COVER, DISPENSER AND METHOD OF USE

(71) Applicant: Sherwood Noël Wagner, Dallas, TX (US)

(72) Inventor: Sherwood Noël Wagner, Dallas, TX (US)

(73) Assignee: Colhurst Covers, LLC, Dallas, TX (US)

( * ) Notice: Subject to any disclaimer, the term of this patent is extended or adjusted under 35 U.S.C. 154(b) by 0 days.

(21) Appl. No.: 16/830,472

(22) Filed: Mar. 26, 2020

(51) Int. Cl.

| | |
|---|---|
| ***B65D 83/08*** | (2006.01) |
| ***B65H 35/04*** | (2006.01) |
| ***B65B 7/28*** | (2006.01) |
| ***B65B 7/01*** | (2006.01) |
| ***B65H 35/00*** | (2006.01) |
| ***B65B 7/16*** | (2006.01) |

(52) U.S. Cl.
CPC ..... *B65D 83/0882* (2013.01); *B65B 7/01* (2013.01); *B65B 7/162* (2013.01); *B65H 35/008* (2013.01); *B65H 35/04* (2013.01); *B65B 7/2814* (2013.01)

(58) Field of Classification Search
CPC .. B65D 83/0882; B65D 83/0847; B65B 7/01; B65B 7/162; B65B 7/28; B65B 7/2814; B65B 7/2807; B65H 35/008; B65H 35/04
See application file for complete search history.

(56) References Cited

U.S. PATENT DOCUMENTS 2,691,856 A 10/1954 Jensen et al.
3,386,619 A * 6/1968 Livingston ..... B65D 83/0841 221/135
3,527,020 A * 9/1970 Mancini ..... B65B 7/16 53/282
3,885,724 A * 5/1975 Ehrlund ..... G07B 3/02 225/77
4,176,507 A * 12/1979 Mancini ..... B65B 7/2878 53/282
4,390,104 A * 6/1983 Cummings ..... A61J 1/1406 156/69
4,474,318 A 10/1984 Perrin
4,514,248 A * 4/1985 Cummings ..... A61J 1/1412 156/268

(Continued)

FOREIGN PATENT DOCUMENTS

DE 102007027389 A1 * 12/2008 ..... B65B 7/2814
JP 2001-155247 A 6/2001

OTHER PUBLICATIONS

Automatic Bubble Tea Cup Sealing Machine 110V 400-600Cups/H Fruit Juice Plastic Drink Cup Sealer, website for product, screenshot captured on May 27, 2020, Amazon.com, Inc., https://www.amazon.com/Electric-Plastic-Automatic-Sealing-300-500cups/dp/B075DCX5ML.

(Continued)

*Primary Examiner* — Christopher R Harmon
(74) *Attorney, Agent, or Firm* — Hitchcock Evert LLP

(57) ABSTRACT

A container cover and dispenser system is disclosed herein. The cover fits over a container and allows a user to access contents through an opening. The cover may include a notch to leave an open section for a user to access the contents. The dispenser may hold a roll of container covers that may be pulled out and individually removed from the roll. The dispenser may include a protrusion to create a tab and notch design on the removed covers to facilitate users' access of the contents.

12 Claims, 6 Drawing Sheets

(56) References Cited

U.S. PATENT DOCUMENTS

| | | | | |
|---|---|---|---|---|
| 4,594,838 | A * | 6/1986 | Ficken | B65B 7/28 53/281 |
| 4,736,568 | A | 4/1988 | Shaw et al. | |
| 4,884,719 | A * | 12/1989 | Levine | B65D 83/0847 221/25 |
| 6,199,347 | B1 * | 3/2001 | Muller | B65B 7/164 53/167 |
| 6,260,727 | B1 | 7/2001 | Durdon | |
| 9,248,469 | B2 * | 2/2016 | Spreck | B31D 1/0018 |
| 9,708,104 | B2 * | 7/2017 | Lyzenga | B65B 61/02 |
| 2008/0135428 | A1 * | 6/2008 | Tallier | B65D 75/66 206/264 |

OTHER PUBLICATIONS

Automatic Boba Tea Boba Cup Sealing Machine TT-A30A, video of product, uploaded to YouTube.com on Nov. 11, 2013, https://www.youtube.com/watch?v=2Kw97lhdb-0.

Generic Sealing Film (PP Cups)—Printed, website for product, screenshot captured on Feb. 19, 2020, Boba Tea Direct, https://www.bobateadirect.com/generic-sealing-film-pp-cups-printed.html.

Mr. Wish Boba Tea Lid, photograph of product, taken on Jan. 30, 2020.

Glad Press'n Seal Plastic Food Wrap—100 sq ft, website for product, screenshot captured on Mar. 30, 2020, Target Brands, Inc., https://www.target.com/p/glad-press-39-n-seal-plastic-food-wrap-100-sq-ft/-/A-14771700.

Glad Press'n Seal Plastic Wrap, 140 Sq Ft, website for product, screenshot captured on Feb. 19, 2020, Jet.com, Inc., https://jet.com/product/Glad-Pressn-Seal-Plastic-Wrap-140-Sq-Ft/51e72973282140c5b936732875dec,e4b.

Ticket Dispenser Take a Number System with 1 Roll 2 Digit Paper 20 Groups Number from 00-99 (2 Digit, red), website for product, screenshot captured on May 28 2020, Amazon.com, Inc., https://www.amazon.com/Ticket-Dispenser-Number-System-Groups/dp/B07HG178H8.

Turn-O-Matic D900 Red/Gray Take a Number Ticket Dispenser, website for product, screenshot captured on May 28, 2020, WebstaurantStore, https://www.webstaurantstore.com/turn-o-matic-d900-red-gray-take-a-number-ticket-dispenser/730D900.html.

Solo LB3081 8 oz. White Tear Tab Lid—100/Pack, website for product, screenshot captured on May 28, 2020, WebstaurantStore, https://www.webstaurantstore.com/dart-solo-lb3081-8-oz-white-tear-tab-lid-pack/999CL308.html.

Veotore Silicone Stretch Lids, Reusable Plastic Wrap Alternative, 6-Pack Eco Friendly Food Storage Covers, Clear Color, website for product, screenshot taken on Mar. 27, 2020, Amazon.com, Inc., https://www.amazon.com/Silicone-Stretch-Reusable-Alternative-Friendly/dp/B077BVLP6W.

* cited by examiner

CONTAINER COVER, DISPENSER AND METHOD OF USE

FIELD OF THE DISCLOSURE

The invention relates to covers or lids for containers, and systems to dispense the covers.

BACKGROUND

Drinks are often served in open containers, such as cups or mugs, at many establishments, such as restaurants, bars, fast food locations, entertainment venues and other locations. Some of these locations may provide lids for a customer to use in open lid holders, which allow a person to pull a pre-sized plastic lid from the holder and place it on his or her cup. Lids may be used to reduce the likelihood that someone spills a drink, to prevent or limit debris or other undesired items from entering the drink, or for other reasons.

Lids are typically made from a solid plastic material in a shape corresponding to a container. Because lids are typically only capable of use on corresponding containers, establishments must carry a variety of lids to correspond with various containers having distinct shapes and sizes.

One problem with providing a variety of lids in open holders is the exposure to airborne materials. Another problem is the ability for a person to touch multiple lids in the process of selecting his or her lid.

Some establishments are less likely to use lids for a number of reasons, such as the aesthetic design of a mug or glass, the sit-down atmosphere, etc. As an example, restaurants and bars that are designed for social interaction are less likely to use containers with lids.

Finally, many lids and coverings are designed for using a straw passing through the lid, allowing a person to drink from an otherwise sealed container. This can lead to additional waste—i.e., a straw.

SUMMARY

The present innovation discloses a flexible container cover that is able to fit and seal multiple container shapes and sizes. The container cover may include a recess designed to provide an opening on the container's edge. The innovation also includes a dispenser designed to allow a user to retrieve one container cover at a time.

In an embodiment, the cover is a flexible material, such as a plastic sheet, that is larger than a drinking opening of a cup, mug or other glass. The edges of the cover may extend enough beyond the rim of the container to be folded down. In some embodiments, the flexible material has an adhesive at least on the outer portions of these extended edges to attach to the outer side of the container and hold the cover in place. In some embodiments, the material may have inherent or embedded properties to grip the outer surface of the container without using adhesives. For example, the material may include static cling properties, textures that suction to a surface, an embedded elastic or other structural designs creating grip.

In some embodiments, the cover includes a notch, which is located on an edge of the cover and designed to provide a drinking opening when the cover is attached to the container. In some embodiments, the cover may include a tab opposite from the notch. The tab may provide a grip for a person to dispense, apply and handle the cover.

In some embodiments, the cover may be one of a plurality of covers on a roll. Each cover may include a notch and a tab, wherein the tab is the material that is removed from the notch. The roll may be pre-perforated in some embodiments along the edge and notch/tab.

The innovation also includes a dispenser for the covers. In some embodiments, the dispenser is designed to mount to a surface. For example, the dispenser may include a mounting attachment, such as an opening to fit over the head of a bolt or screw, hook and loop tape, magnets, interconnecting frames, or other mounting features. In other embodiments, the dispenser may be free standing.

The dispenser may be a single use dispenser that is intended to be recycled or thrown away once emptied. In other embodiments, the dispenser may be configured to allow replacement of a set of covers—such as a roll of covers—allowing the dispenser to be reused.

In some embodiments, the dispenser holds a roll of material for covers on a rotatable axis. For example, the dispenser may have a rod that passes from one side of the dispenser to the other with a roll of covers fitted over the rod that is able to turn to allow the covers to be removed from a front of the dispenser. In some embodiments, the covers pass through a channel located in the front of the dispenser. The channel may lead to an edge having a series of teeth designed to cut the material to form covers. The cutting edge may include an extended portion with teeth extended forward from other teeth on the edge. While the material is cut, this protruding edge portion may create a notch in the removed piece of material and a tab on the next piece of material. In addition, the remaining tab may stick to the extended protrusion or channel structure to hold the film in place until it is used for the next cover.

Embodiments of the cover may also be individually packaged. The packaging may be designed to keep the cover in a sanitary state until applied to a container. When opened, the package may allow a person to remove the cover and expose the adhesive or gripping surface in a series of steps while attaching the cover to a container so that a person can apply the cover without touching it or with minimal contact to it.

A BRIEF DESCRIPTION OF THE DRAWINGS

Embodiments will now be described, by way of example only, with references to the accompanying drawings in which.

DETAILED DESCRIPTION

While this invention may be embodied in many different forms, there will herein be described in detail preferred embodiments of the invention with the understanding that the present disclosure is to be considered as an exemplification of the principles of the invention and is not intended to limit the broad aspects of the invention to the embodiments illustrated. It will be understood that the invention may be embodied in other specific forms without departing from the spirit or central characteristics thereof. The present embodiments, therefore, are to be considered in all respects as illustrative and not restrictive, and the invention is not to be limited to the details given herein.

Figure 1A:
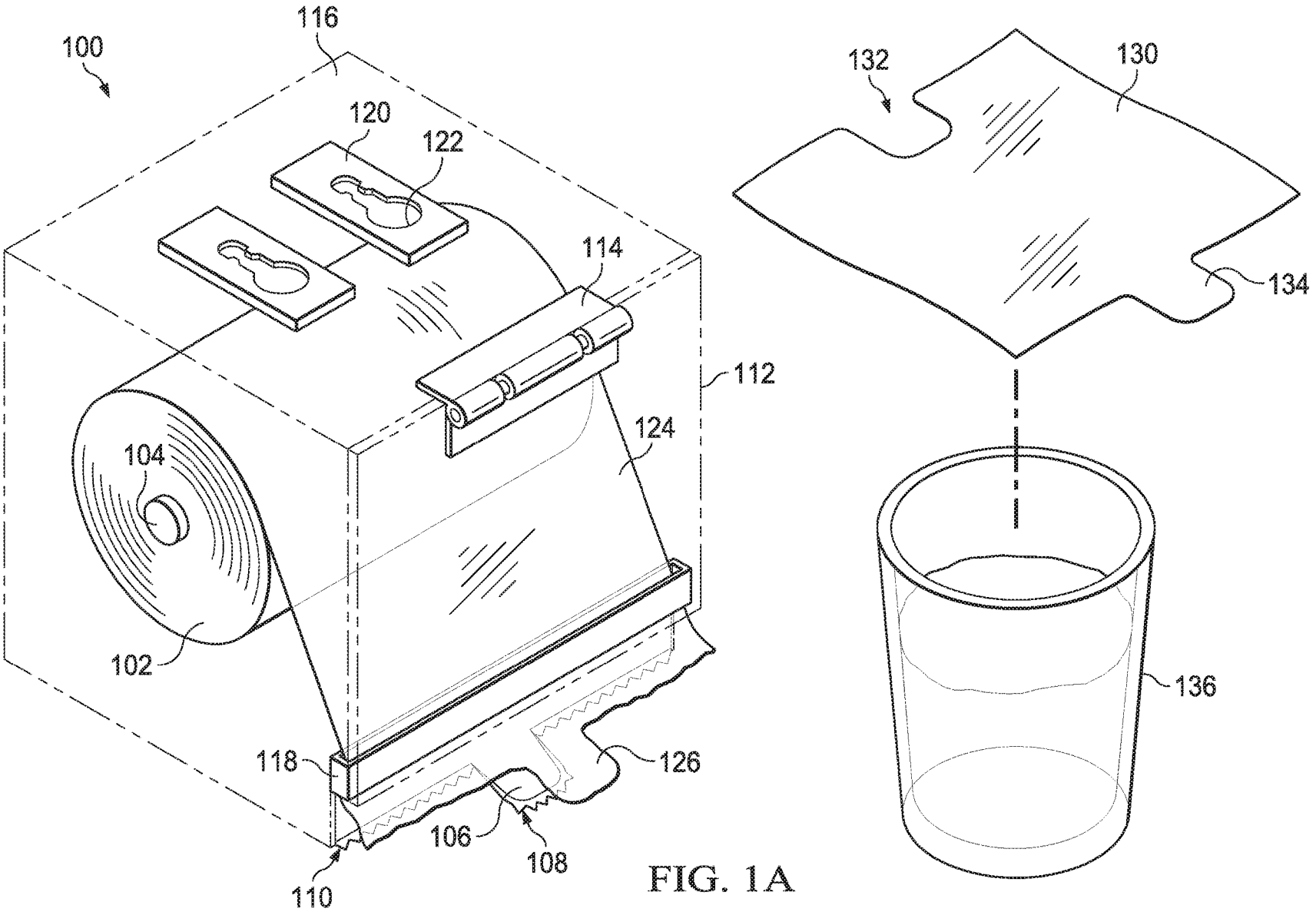
FIG. 1A is a perspective view of embodiments of a dispenser for container covers and a cover that is shown above a container.

FIGS. 1A through 1E illustrate an embodiment of a dispenser 100 for container covers, such as the container cover 130, and use of the container cover 130 on a container 136. FIG. 1A shows the dispenser 100 in the shape of an enclosed box. In some embodiments, the dispenser 100 may be a different shape, such as a cylinder or trapezoid, or an open structure.

A roll 102 having container covers is held within the dispenser 100. The roll 102 is attached to the rod 104. In some embodiments, the roll 102 has a tube through which the rod 104 passes, allowing the roll 102 to rotate around the rod 104. In other embodiments, the roll 102 may be connected to the rod 104, wherein the rod 104 turns with the rotation of the roll 102.

In some embodiments, the rod 104 is supported by corresponding holes in the opposing side walls of the dispenser 100. The holes may be configured to hold the rod 104 in place or to allow the rod 104 to rotate. In other embodiments, the rod 104 may be held in place by a rack or notch built into the inner surface of the side walls. Some embodiments may include alternative holders. For example, the rod 104 may be replaced with shorter pegs placed on each side that only pass inside the dispenser 100 far enough to fit inside a tube of the roll 102. In other embodiments, the roll 102 may be placed on one or more rotatable rods that support the roll 102 and allow the roll 102 to rotate during use.

In this embodiment, the dispenser 100 includes a front wall 112 connected to the top wall 116 by the hinge 114. This allows a user to open the dispenser 100 and replace the roll 102 with another roll 102. In such embodiments, the dispenser 100 may be made from materials designed to withstand repetitive use, limit the likelihood of contamination and allow sanitary cleaning of the dispenser 100. For example, the dispenser 100 may be made from plastic, polycarbonate, silicone, nylon, metal, wood, chitin or other materials.

In some embodiments, the dispenser 100 may be intended to be used once prior to disposal. In such embodiments, the dispenser 100 may be made of less durable products, such as cardboard, paper, softer or more breakable plastics or other materials.

Connectors 120 are located on the top wall 116 of this embodiment of the dispenser 100. Other embodiments may include connectors 120 on other surfaces of the dispenser 100 instead of or in addition to the connectors 120 on the top wall 116. For example, one or more connectors 120 may be located on a back wall of the dispenser 100. In addition, connectors may be located on the bottom or side walls of the dispenser 100.

The dispenser 100 also includes a channel 118 in the front. In this embodiment, the channel 118 is adjacent to the bottom of the front wall 112 and near the bottom of the dispenser 100. The channel 118 provides a pathway for the film 124 from the roll 102 to pass from inside the dispenser 100 to an exterior of the dispenser 100 for use as a container cover 130.

The bottom edge of the dispenser 100 includes teeth 110 around a protrusion 106, which includes additional teeth 108. The teeth 108 and 110 are aligned below the film 124 that passes through the channel 118. When the film 124 is pulled downward, the teeth 108 and 110 engage and cut the film 124. In this embodiment, the protrusion 106 causes teeth 108 to begin cutting the film 124 prior to the teeth 110 engaging the film 124. In some embodiments, the protrusion 106 may include teeth or another cutting edge along the sides of the protrusion 106 in addition to the front teeth 108. These side teeth may assist in cutting the film 124 as it is pulled down to the teeth 110.

In some embodiments, the teeth 108 and 110 may be configured to engage at the same time. For example, the teeth 108 and 110 may be oriented at a slight upward angle such that pulling downward causes both sets of teeth 108 and 110 to engage the film 124 at approximately the same time. As another example, the protrusion 106 may be offset below the bottom edge with teeth 110, which may allow the teeth 108 and 110 to engage closer to the same time. Engaging at or near the same time may limit the ability for the film 124 to slip or shift during the cutting process.

When the film 124 is cut, the remaining film includes a tab 126 formed by the protrusion 106. The removed piece of film 124 is a container cover 130. The section of film 124 that remained forming the tab 126 on the end of the roll 102 leaves a notch 132 in the container cover 130. In addition, the prior tab 134 extends from the opposite side of the container cover 130 from the notch 132.

The film 124 and container cover 130 may be made from materials that are flexible, lightweight, able to be torn into a shape without weakening the overall structural integrity, and able to limit the likelihood of contamination. For example, the container cover 130 may be made from plastic, polycarbonate, silicone, nylon, bamboo, chitin, bioplastics (such as those made from algae) or other materials.

Figure 1B:
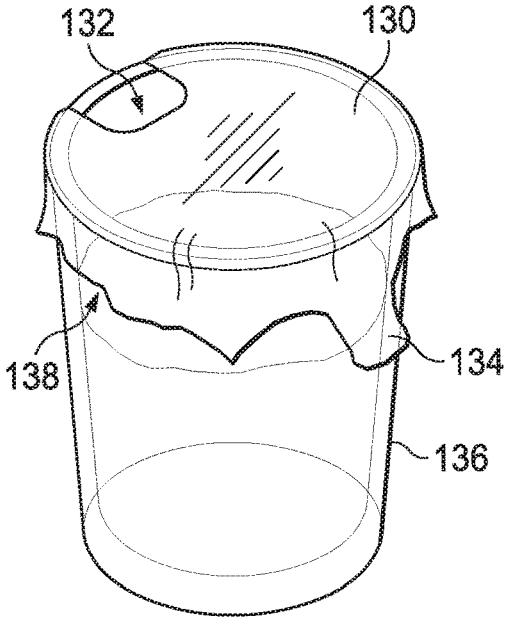
FIG. 1B is a perspective view of the cover applied to a container.

FIG. 1B illustrates the container 136 with the container cover 130 attached over the container 136's opening. The container cover 130 extends over the rim of the container 136 and is folded down around the container 136. The container cover 130 attaches to the rim of the container 136 and the extended portion of the container cover 130 attaches to the exterior sides of the container 136. The container cover 130 may attach using adhesives, gripping textures, elastic, static cling or any other attachment feature.

The notch 132 in the container cover 130 provides a drink opening between the container 136's rim and the container cover 130. This drink opening provides a space to allow a user to enjoyably drink from the container 136, while limiting the available space for debris or any unwanted item to enter the drink. For example, a patron at a bar may use the container cover 130 to limit the likelihood that someone places a foreign object or drug into the container 136. As another example, a parent may place a container cover 130 over a child's cup at an outdoor venue to limit dust and dirt from blowing into the cup. In addition, the container cover 130 may also limit spills due to splashing contents, tipped cups and other circumstances.

In some embodiments, the container cover 130 may be shifted to eliminate the drink opening provided by notch 132. This may be used as a temporary seal until a user adjusts the container cover 130 in some embodiments. The container cover 130 may also be made of a film that allows a user to insert a straw through the container cover 130 to allow a user to drink. Embodiments may include a perforated straw opening or be designed to allow a straw to puncture the container cover 130 without perforations.

Figure 1C:
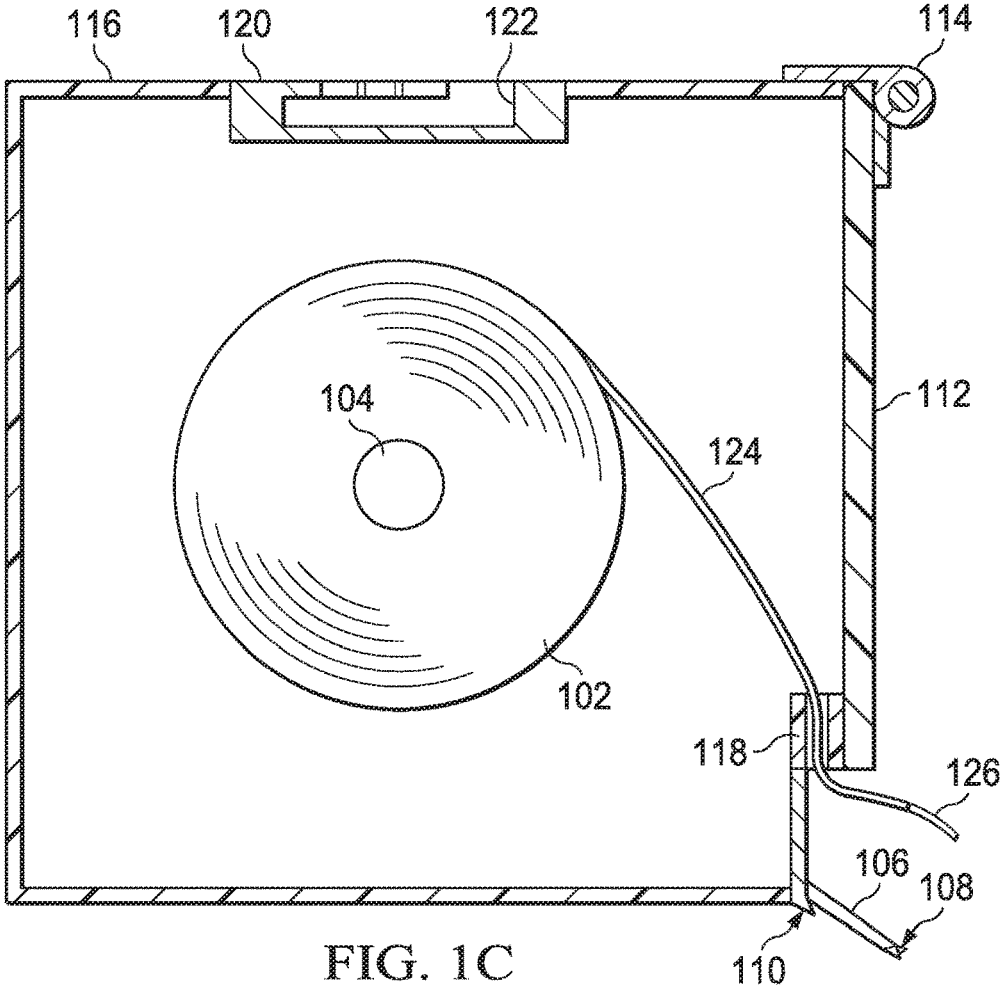
FIG. 1C is a cross-section view of the dispenser.

FIG. 1C illustrates a cross-section of the dispenser 100 passing through one of the connectors 120 in the top wall 116. This view further illustrates how the film 124 passes from the roll 102 within the internal cavity of the dispenser 100 through the channel 118 to the exterior of the dispenser 100. In this embodiment, the hinge 114 allows the front wall 112 to open and close as needed for access to the interior. In some embodiments, the front wall 112 may include metal and the channel 118 may be magnetized to hold the front wall 112 in place. In other embodiments, the front wall 112 may be connected to the channel 118 through mechanical clips, snaps or other connectors. In yet other embodiments, the front wall 112 may abut the channel without attaching to the channel 118.

Figure 1D:
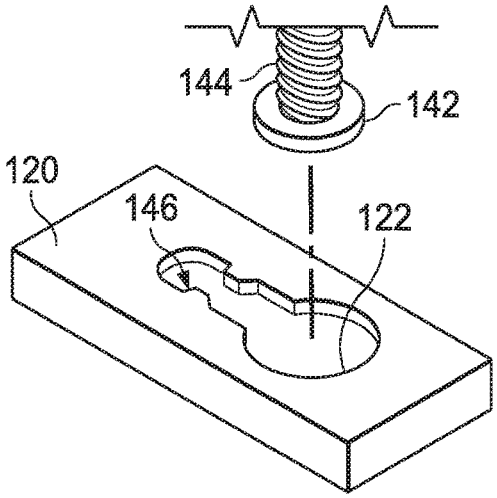
FIG. 1D is a perspective view of a connector for the dispenser shown below a connecting screw.
Figure 1E:
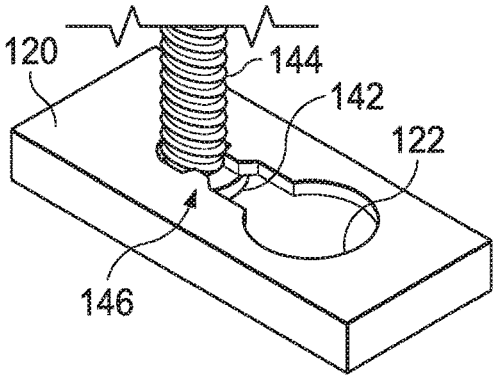
FIG. 1E is a perspective view of a connector for the dispenser engaged with the connecting screw.

The connectors 120 in this embodiment are further understood with reference to FIGS. 1D and 1E, which illustrate the connectors' 120 relationship with a screw or bolt for mounting the dispenser 100. In other embodiments, the screw may be replaced with other connectors, such as a bolt, a protrusion having a head that is larger than a shaft, or other connecting feature. FIG. 1D illustrates the connector 120 prior to fitting over the screw and FIG. 1E illustrates the connector 120 engaged with the screw with the screw head 142 fitted against the bottom surface of the connector 120 defining the opening 122. The opening 122 in the connector 120 includes a larger opening on a first side to allow a screw head 142 to pass into the connector 120. The opening 122 is narrower at the second side to allow the screw shaft 144 to slide from the first side to the second side without letting the screw head 142 pass through once secured on the second side.

In this embodiment, the connector 120 includes projections 146 near the second side of the opening 122. These projections 146 allow the screw shaft 144 to pass through to the second side of the opening 122 as the dispenser 100 is moved into place. Once the screw shaft 144 is in place at the second side of the opening 122, the projections hold the dispenser 100 in place on the screw until a sufficient force is applied to make the projections 146 pass the screw shaft 144 allowing the screw head 142 to reach the first side of the opening 122. The dispenser 100 may then be removed from the screw through the larger opening on the first side of opening 122.

In some embodiments, the connector 120 may be located on a mounting surface, such as under a counter, and the screw or other connector designed to fit into the connector 120 may be located on the exterior surface of the dispenser 100.

In some installations or applications of the dispenser 100, the dispenser 100 may be used in a different orientation. For example, dispenser 100 may be mounted on top of a counter with the back wall facing down and the front wall 112 facing up. The container cover 130 may then be removed by pulling the film 124 upward through the channel 118 and then forward toward the cutting edge with teeth 108 and 110.

Figure 2:
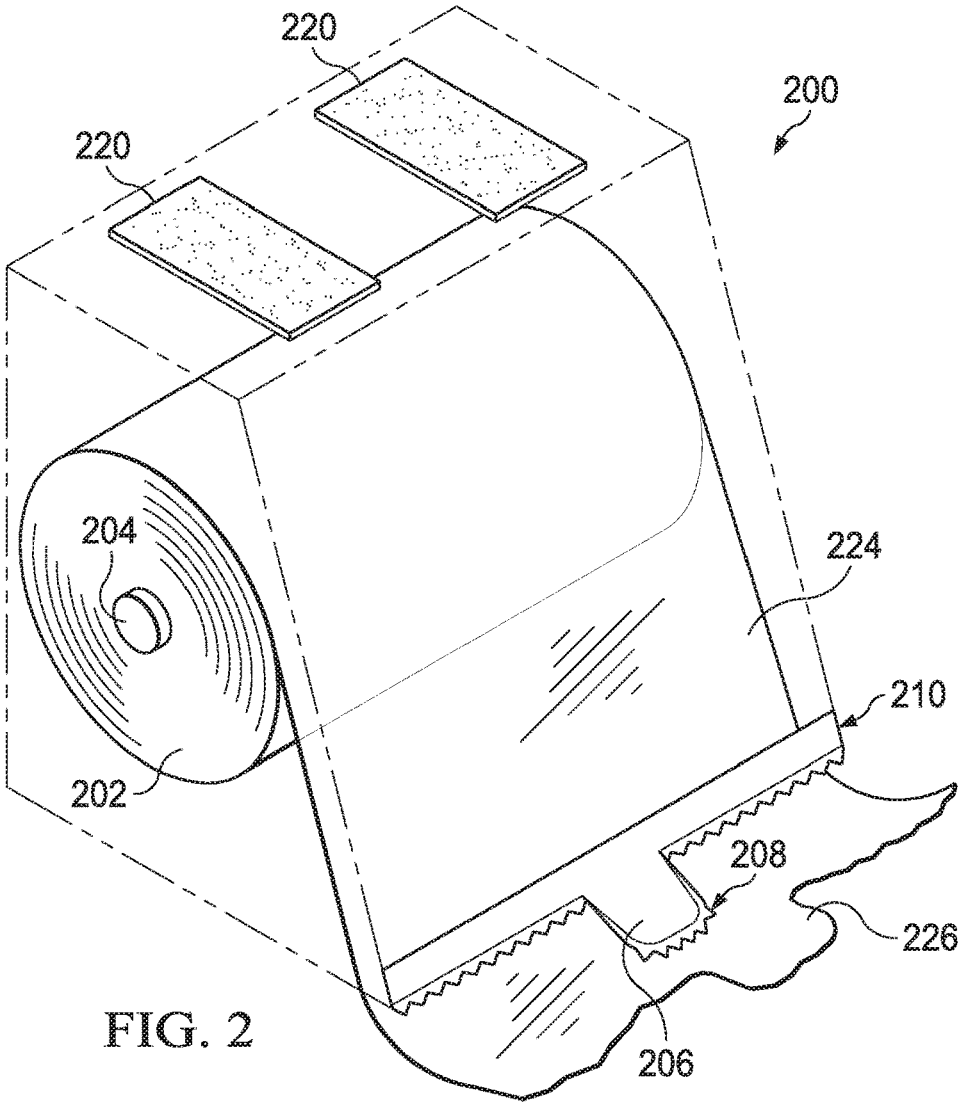
FIG. 2 is a perspective view of another embodiment of a dispenser for container covers.

FIG. 2 shows another dispenser 200 for container covers. The dispenser 200 is a trapezoidal shape with the front wall angled forward from the top to the bottom. The dispenser 200 houses a roll 202 of film 224, which may be cut to create container covers. Similar to FIG. 1A, the roll 202 may be attached to the rod 204 directly or indirectly. For example, the roll 202 may include a tube through which the rod 204 passes, allowing the roll 202 to rotate around the rod 204. The rod 204 may extend partially into the roll 202 and a second rod 204 may extend partially into the opposite side of roll 202, which allows the roll 202 to rotate around the axis defined by the rods 204.

In this embodiment, the film 224 passes out of the dispenser 200 at or near the bottom and below a cutting edge. In other embodiments, the opening for the film 224 to exit the dispenser 100 may be at other locations, such as the middle of the front wall or out the top wall. The cutting edge includes teeth 210 and a protrusion 206 with teeth 208.

During operation, the tab 226 of film 224 will be pulled forward a sufficient length to create a container cover. Then the film 224 may be pulled upward to engage the teeth 208 and 210 forming the cutting edge. As the film 224 is pulled upward, the teeth 208 and 210 will cut the film 224 to form the container cover. The remaining film 224 will have a new leading tab 226. As discussed with FIG. 1A, the film 224 may engage the teeth 208 prior to the teeth 210 in some configurations. In other configurations, the teeth 208 and 210 may be positioned or oriented to allow the film 224 to engage both sets of teeth 208 and 210 at approximately the same time.

The removed container cover will then be attached to the top of a container by pressing the extended portion of the container cover against the exterior surface of the container below the rim. A notched portion of the container cover may be placed at least partially over the top of the container to create a drinking opening. Alternatively, the user may shift the container cover to seal the top of the container without the overlapping notch. The user or another person may open a section of the container cover for drinking or puncture the top with a straw.

The dispenser 200 also includes connectors 220 shown on the top surface. The connectors 220 may be hook-and-loop tape (such as Velcro® tape), adhesive strips, magnets or any other connector. The connectors 220 allow the dispenser 200 to be attached to a bottom surface of a counter, table or other structure. The dispenser 200 may also be turned upside down to attach the dispenser 200 to a top surface of a structure. The dispenser 200 may also include one or more connectors 220 on the bottom surface to attach the dispenser 200 to the top of a structure. In some embodiments, corresponding components to connectors 220 may be attached to the counter. For example, the dispenser 200 may attach to the top surface of a counter using hook-and-loop tape, with strips of loops attached to the countertop and corresponding hooks on the bottom of the dispenser 200.

The dispenser 200 may be a disposable version, which is designed to be recycled or trashed after the roll 202 is used. For a disposable version, the dispenser 200 may be made of a biodegradable material, such as cardboard, chitin or a bioplastic, with sufficient strength to withstand use over the expected life of the product—that is, until the roll 202 is completely used.

Figure 3A:
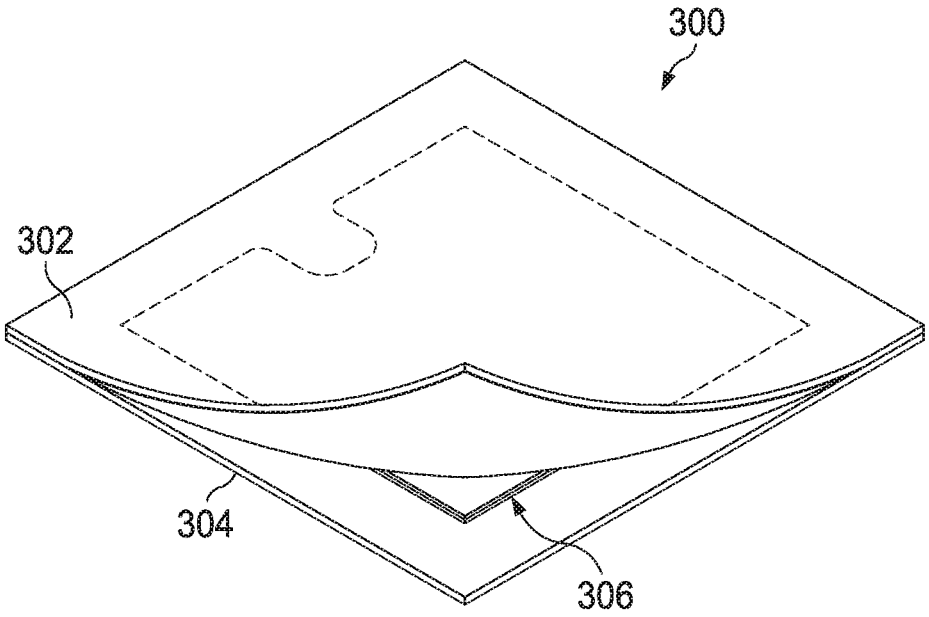
FIG. 3A is a perspective view of another embodiment of a container cover in a single use package that has the package open to a first position.
Figure 3B:
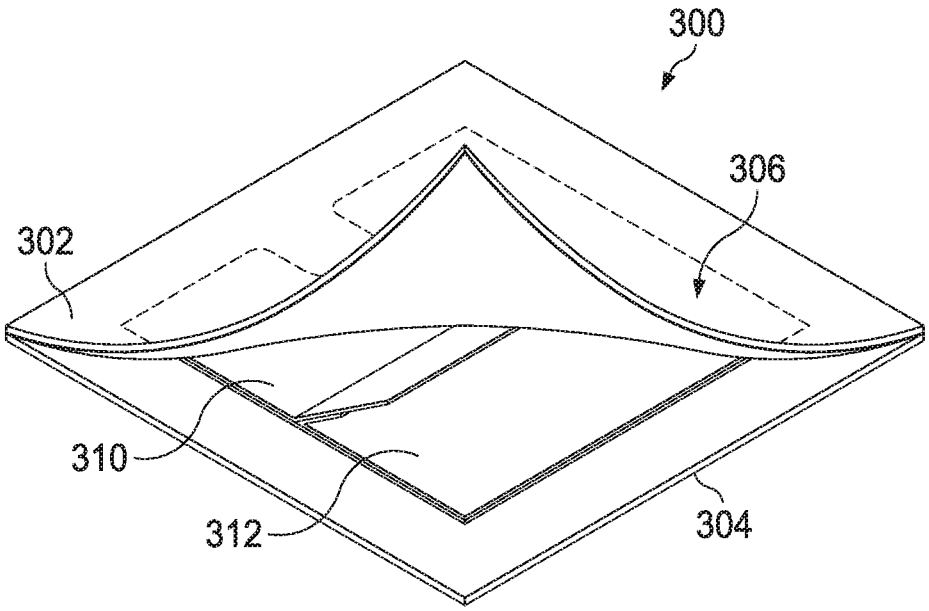
FIG. 3B is a perspective view of another container cover in a single use package having the package open to a second position.
Figure 3C:
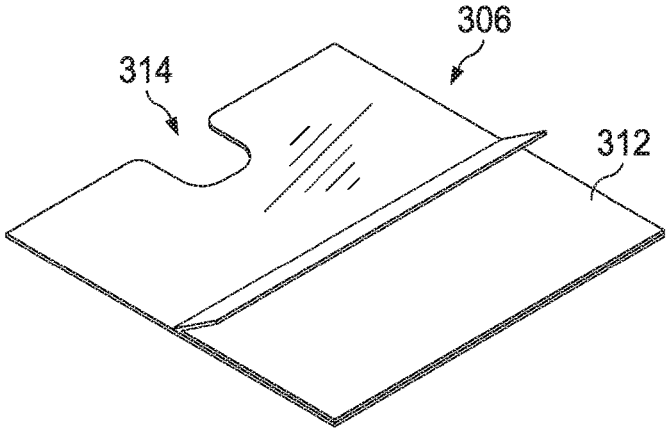
FIG. 3C is a perspective view of the container cover with a tabbed, removable film attached to the container.

FIGS. 3A through 3C illustrate embodiments of an individually packaged container cover 300. The packaging comprises a top layer 302 and a bottom layer 304 that attach to each other around the outer edges and encase a container cover 306. The top layer 302 and the bottom layer 304 may be attached by an adhesive, a heat seal or other connection to hold the layers 302 and 304 together. These layers 302 and 304 may be made of a paper, plastic, biodegradable material or other materials. In some embodiments, the edge may include an area that is not attached in order to allow a user to pull the layers 302 and 304 apart. For example, a corner may include a small portion in which the layers 302 and 304 are not connected. A user may separately grip the corner of layer 302 and the corner of layer 304, and then pull the layers 302 and 304 apart to expose the container cover 306.

The container cover 306 may have one surface that includes an adhesive, grip or other attachment feature at least around an outer portion of the container cover 306. As discussed, the attachment feature is designed to attach the container cover 306 to the exterior surface of a container around a container's rim.

In one embodiment of the individually packaged container cover 300, the top layer 302 includes a nonstick interior surface that is placed against the attachment feature of container cover 306. When the package is peeled opened, the top layer 302 pulls away from the bottom layer 304 and the container cover 306 exposing the attachment feature. The user may then place the bottom layer 304 and container cover 306 onto a container top with the container cover 306 contacting the container. The bottom layer 304 may then be removed leaving the container cover 306 on the container. This may allow one person to cover a drink meant for another without touching the container cover 306 directly.

FIG. 3B illustrates an embodiment of the individually packaged container cover 300 including additional layers 310 and 312 attached to the container cover 306. In this embodiment, the attachment section of the container cover 306 may be protected by the additional layers 310 and 312 until use. Other embodiments may use a single additional layer to peel back during attachment to the container.

A person may open the individually packaged container cover 300 by removing the top layer 302 and the bottom layer 304 from the container cover 306. Then the person may remove the first additional layer 310 using the raised tab to expose the attachment feature for one side of the container cover 306. FIG. 3C illustrates a container cover 306 with the first additional layer 310 removed. The exposed attachment feature may be pressed onto a container with the notch 314 placed over the container top to create a drinking opening. As the container cover 306 is held in place, the second additional layer 312 is removed using its tab feature. Finally, the remaining portion of the container cover 306 is pressed into place on the container.

Figure 4:
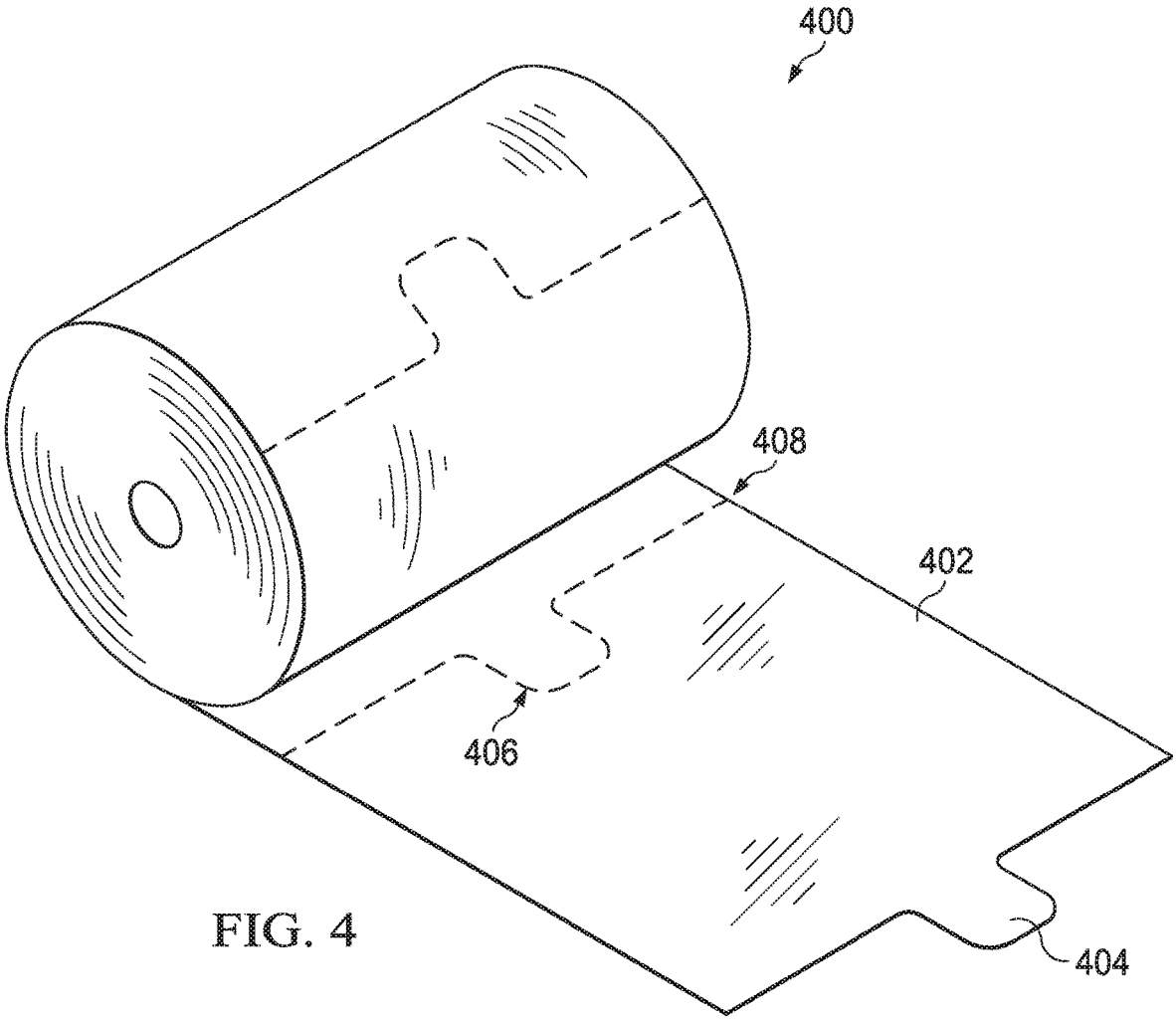
FIG. 4 is a perspective view of another embodiment of a container cover roll with perforations.

FIG. 4 teaches a perforated roll 400 of container covers 402. In this embodiment, the container covers 402 are part of a film wherein each container cover 402 is separated by a perforation 408. Each container cover includes a tab 404 and notch 406 in this embodiment. The tab 404 and notch 406 work the same as described in other embodiments to provide a portion to hold and provide a drink opening when applied to a container. Other embodiments may not include a tab 404 and notch 406. For example, the film may be perforated on a line parallel to the central axis of the roll 400 so that the container covers 402 have a rectangular shape. As another example, the roll 400 may be perforated with straight lines to tear rectangular shapes and include a perforation for a notch 406 that may be removed by the person who will drink from the cup.

This perforated roll 400 may be placed in a dispenser or other container configured to allow a user to unwind the roll 400 and remove individual container covers 402. For example, the roll 400 may be placed on a metal rod with a bar in front to assist in tearing the container covers 402 apart along the separation line created by the perforation 408. In some embodiments, a dispenser may include a bar or support that mimics the shape of the perforation 408 to support the remaining film as a container cover 402 is removed.

Figure 5:
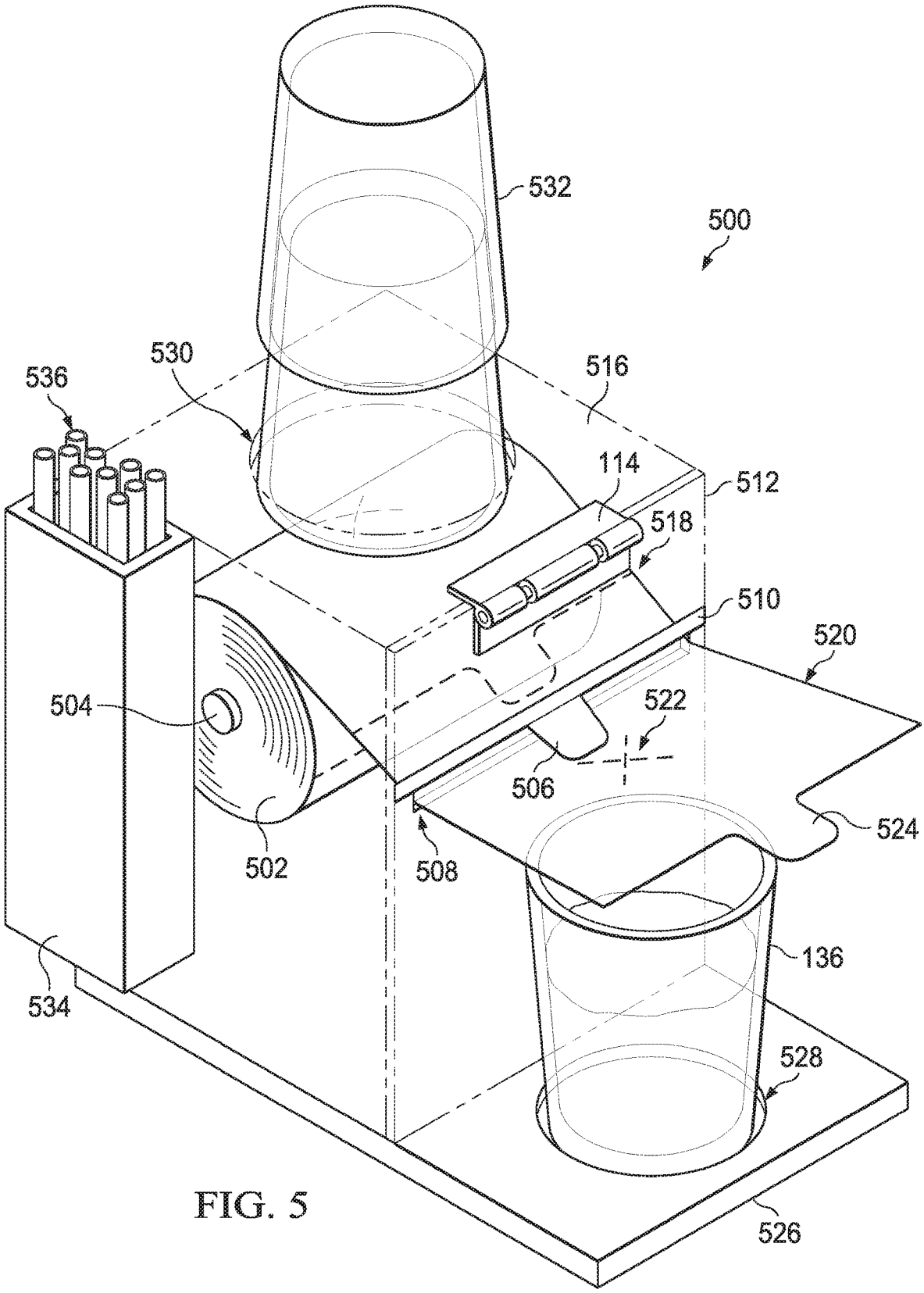
FIG. 5 is a perspective view of an embodiment of a drink covering assembly.

FIG. 5 illustrates a drink covering assembly 500 that dispenses container covers 520. The assembly 500 includes a dispenser housing for the roll 502 on a base 526. The roll 502 is rotatably attached to a rod 504 or to a set of rotatable connectors similar to other embodiments. The front wall 512 of the housing is connected to the top wall 516 of the housing by the hinge 114. The hinge 114 allows the front wall 512 to open. A user may open the front wall 512 to replace the roll 502, to clean the assembly or for other reasons.

In this embodiment, the front wall 512 includes an opening 508 through which the film of container covers 520 passes from inside the housing to outside the housing. The opening 508 is in the upper portion of the front wall 512 at a height above the top of the cup 136. The top of opening 508 includes an edge 510 and a protrusion 506 designed to support the film when a container cover 520 is removed from the roll 502. In this embodiment, the edge 510 and protrusion 506 do not include teeth for cutting. In other embodiments, teeth may be placed on one or more of the cutting or tearing edges.

In this embodiment, the roll 502 includes a film that has perforations 518 separating each container cover 520. The container covers 520 include a central perforation 522, shown in the shape of an X, to allow a user to insert a straw, decorative feature or other item. The container covers 520 are shown with a tab 524, which also creates a corresponding notch in the removed container covers 520. In some embodiments, container covers 520 may be alternative shapes, such as squares, rectangles, polygons, circles and other shapes that may be used to fit over a container or cup 136.

The base 526 includes a cup holder 528 to hold a filled container to be covered, which may be fitted for specific cups 136 or an opening designed to hold different size cups 136. In some embodiments, the front of base 526 extends over the edge of a structural surface, such as a countertop, and the cup holder 528 allows a cup 136 to slide down until the width of the cup 136 is larger than the opening of cup holder 528. The cup holder 528 may include a bottom in some embodiments to ensure a cup 136 does not fall through the cup holder 528. In some embodiments, the cup holder 528 may be designed to hold any size or style of drinking container, such as a stemmed glass, a mug, a stemless wine glass, shot glass or other drinking container. As an example, the base 526 may include an opening to access the cup holder 528 allowing stemmed glasses to be placed in the same cup holder 528.

In this embodiment, the assembly 500 includes a second cup holder 530 on the top wall 516 of the housing. This second cup holder 530 is designed to hold one or more empty cups 532. A person may remove one empty cup 532 from the top of the assembly 500 to pour a drink and then place it in the cup holder 528 to be covered.

In addition, this embodiment of the assembly 500 includes a straw holder 534 on the side of the housing with a plurality of straws 536. After the person makes a drink and covers it with a container cover 520, he or she may pick a straw 536 and push it into the container cover 520 through the central perforation 522.

This assembly 500 may be used in an establishment that serves drinks to provide a cover for customers. For example, a bartender may have the assembly 500 on the counter behind the bar. When a drink is ordered, the bartender may pull a glass 532 from the top of the assembly 500 and fill it with the selected drink. The glass (now 136) is placed in the cup holder 528 while the bartender pulls a container cover 520 out from the housing. The bartender pulls the film up against the cutting edge 510 and protrusion 506 when the perforation 518 is in place, causing the film to tear along the perforation 518. When the container cover 520 is torn from the film, the bartender then places it over the top of the glass 136 and presses it to the exterior side to attach the container cover 520. The bartender may align the notch to allow a drinking opening along the edge of the glass 136. Alternatively, the bartender can align the notch over the side of the glass 136 to create a seal, and place a straw 536 through the central perforation 522 or give the straw 536 and covered glass 136 to a customer.

The container covers disclosed herein may vary in shape, size and other characteristics. For example, the container covers may be circles, ovals, squares, rectangles, triangles, polygons or any other shapes configured to fit over all size mugs and glasses. In addition, while the container cover system has been described for a drinking cup, the same system may be used for alternative covers, such as containers for paint, sauces, candy, snacks or other items.

The invention being thus described and further described in the claims, it will be obvious that the same may be varied in many ways. Such variations are not to be regarded as a departure from the spirit and scope of the invention, and all such modifications as would be obvious to one skilled in the art are intended to be included within the scope of the apparatus, system and method described.

The invention claimed is:

1. A container cover system comprising:
- a container cover roll, which comprises a film that is formed into a container cover;
- a dispenser having
  - a housing,
  - a roll holder that supports the container cover roll inside the housing,
  - a channel in the housing through which the film passes,
  - a protrusion extending from an exterior edge of the channel, and
  - a cutting edge along the exterior edge of the channel and on a protruding edge of the protrusion; and
- wherein the film is pulled through the channel and cut on the cutting edge to form the container cover, which comprises a tab on a first edge and a notch on a second edge opposite from the first edge, wherein the notch forms an opening when attached to a container.

2. The container cover system of claim 1, wherein the film has an adhesive on one surface, wherein the adhesive holds the container cover to an exterior surface of the container.

3. The container cover system of claim 1, wherein the film has a texture on one surface that grips an exterior surface of the container.

4. The container cover system of claim 1, wherein the film is perforated to define a separation line for the container cover.

5. The container cover system of claim 1, wherein the housing includes a connector that attaches the dispenser to a surface.

6. The container cover system of claim 5, wherein the connector is at least one of a hook and loop tape, a fitted opening for the head of a corresponding connector, an adhesive or a magnet.

7. The container cover system of claim 1, wherein the housing includes a wall that opens to allow access to the container cover roll.

8. The container cover system of claim 1, wherein the dispenser includes a cup holder.

9. A method of covering a container comprising:
- pulling a container cover from a dispenser, which includes a roll of container covers and a cutting edge that includes a protruding section;
- cutting the container cover from the roll of container covers using the cutting edge, wherein the container cover includes a notch on one side of the container cover;
- placing the container cover over an open top of a container with the notch extending over the open top; and
- pressing outer edges of the container cover around exterior surfaces of the container, wherein the notch that is extending over the open top of the container forms an access opening.

10. The method of covering a container of claim 9, wherein the cutting edge comprises teeth, which are configured to engage the container cover during operation at a substantially concurrent time.

11. The method of covering a container of claim 9, wherein the cutting edge is above a channel, wherein the step of cutting the container cover from the roll of container covers further comprises moving an extended portion of the roll of container covers upward to cut the container cover using the cutting edge.

12. The method of covering a container of claim 9, wherein the cutting edge is below a channel, wherein the step of cutting the container cover from the roll of container covers further comprises moving an extended portion of the roll of container covers downward to cut the container cover using the cutting edge.

* * * * *